US008328080B2

(12) United States Patent
Davies

(10) Patent No.: US 8,328,080 B2
(45) Date of Patent: Dec. 11, 2012

(54) DOCUMENT PRODUCTION USING IMAGE TRANSFER TO MATED SUBSTRATE

(75) Inventor: David S. Davies, Ham Lake, MN (US)

(73) Assignee: Deluxe Corporation, Shoreview, MN (US)

( * ) Notice: Subject to any disclaimer, the term of this patent is extended or adjusted under 35 U.S.C. 154(b) by 242 days.

(21) Appl. No.: 12/842,888

(22) Filed: Jul. 23, 2010

(65) Prior Publication Data

US 2011/0017816 A1 Jan. 27, 2011

Related U.S. Application Data

(60) Provisional application No. 61/228,388, filed on Jul. 24, 2009.

(51) Int. Cl.
*G07G 1/00* (2006.01)

(52) U.S. Cl. ..... 235/3

(58) Field of Classification Search ..... 235/3, 379; 283/58

See application file for complete search history.

(56) References Cited

U.S. PATENT DOCUMENTS 5,173,080 A * 12/1992 Longtin ..... 462/2
7,974,921 B1 * 7/2011 Al Amri ..... 705/45

* cited by examiner

*Primary Examiner* — Seung Lee
(74) *Attorney, Agent, or Firm* — Schwegman, Lundberg & Woessner, P.A.

(57) ABSTRACT

A system in which a check and its duplicate are formed. In an embodiment, a mating device mates a base stock of a negotiable instrument with a base stock of a duplicate negotiable instrument to form mated base stock. In one embodiment, the base stock of the duplicate negotiable instrument has a photosensitive coating applied to a portion of the duplicate negotiable instrument. A printing device may be used to print personalized information on the base stock of negotiable instrument portion of the mated base stock. Also, an exposure unit may be used to apply light to the mated base stock, wherein the application of the light to the mated base stock transfers a portion of the personalized information on the negotiable instrument to the duplicate negotiable instrument.

20 Claims, 5 Drawing Sheets

DOCUMENT PRODUCTION USING IMAGE TRANSFER TO MATED SUBSTRATE

RELATED APPLICATION

This patent application claims the benefit of priority, under 35 U.S.C. §119(e), to U.S. Provisional Patent Application Ser. No. 61/228,388, filed on Jul. 24, 2009, which is incorporated herein by reference in its entirety.

BACKGROUND

Checks and other negotiable instruments are used between people and/or companies many times a day to complete financial transactions. In some instances, the check will have a duplicate version such that each party to the transaction will have a record of the transaction details. A large amount of time and cost is devoted to making safe checks and duplicates. Every check has to contain some personalized information to associate to the drafter of the check. The personalization adds to the overall printing task and can result in a number of steps to the production of books of personalized checks with duplicate blanks. There is a need in the art for a better way to make duplicates which reduces overall production time and cost.

BRIEF DESCRIPTION OF THE DRAWINGS

Various embodiments are illustrated by way of example in the figures of the accompanying drawings. Such embodiments are demonstrative and not intended to be exhaustive or exclusive embodiments of the present subject matter.

DETAILED DESCRIPTION

The following detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is, therefore, not to be taken in a limiting sense, and the scope is defined only by the appended claims, along with the full scope of legal equivalents to which such claims are entitled.

In some embodiments, negotiable instruments such as checks, purchase agreements, leases, or other contracts have duplicate versions that are mated to the original negotiable instrument. For instance, a booklet of checks will have a set of duplicate checks that are mated to the originals. In this manner, a person may store or otherwise keep a record of any checks that are written. In an example embodiment, an original check has personalized information such as a name, address, accounting number, etc., which is also printed on the associated duplicate check. The duplicate check has information common to record keeping such as a balancing portion and a tracking portion (e.g., categories). Both the original and duplicate check may also have information that is common to all checks such as signature and memo lines.

In an embodiment, a printing system is used that uses one printing process to allow the legible transfer of information from a negotiable instrument to its associated duplicate. The printing system includes a base stock of a negotiable instrument (original base stock) and a base stock of a duplicate negotiable instrument (duplicate base stock) with a light sensitive coating applied. The two base stocks are mated together to form a mated base stock. In an embodiment, the mated base stock is exposed to a light (e.g., laser light, UV light, or a visible light source) and information on the base stock of the negotiable instrument is transferred to the coated areas of the base stock of the duplicate negotiable instrument in a human readable form. By using the process above to transfer information from the original base stock to the duplicate base stock, only half as much printing may be needed to obtain a duplicate base stock with personalized information as compared to having to print personalized information on both the original and duplicate base stock.

Figure 1:
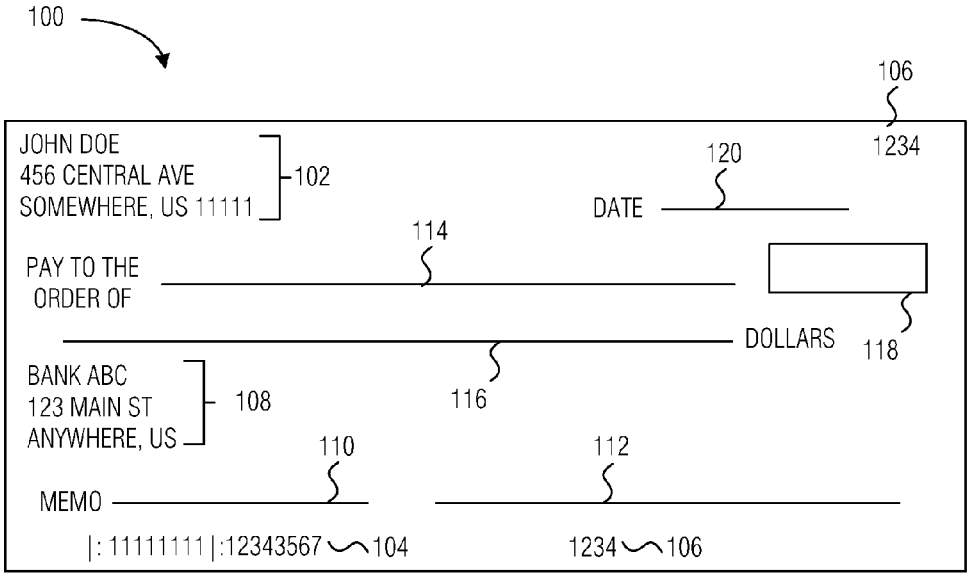
FIG. 1 is a simplified diagram of a check, according to one embodiment of the present subject matter.

FIG. 1 illustrates an example original check 100. Original check 100 is an example of a negotiable instrument, but other negotiable instruments may be used in further embodiments. Original check 100 includes personalized information such as a name and address block 102, account and routing numbers 104, a check number 106. In further embodiments, personalized information includes one or more phone numbers, an e-mail address, and a custom background. Also shown is bank specific contact information 108. In an embodiment, information common to all checks includes a memo line 110, a signature line 112, a pay to line 114, an amount line 116, a dollar box 118, and a date line 120.

Figure 2:
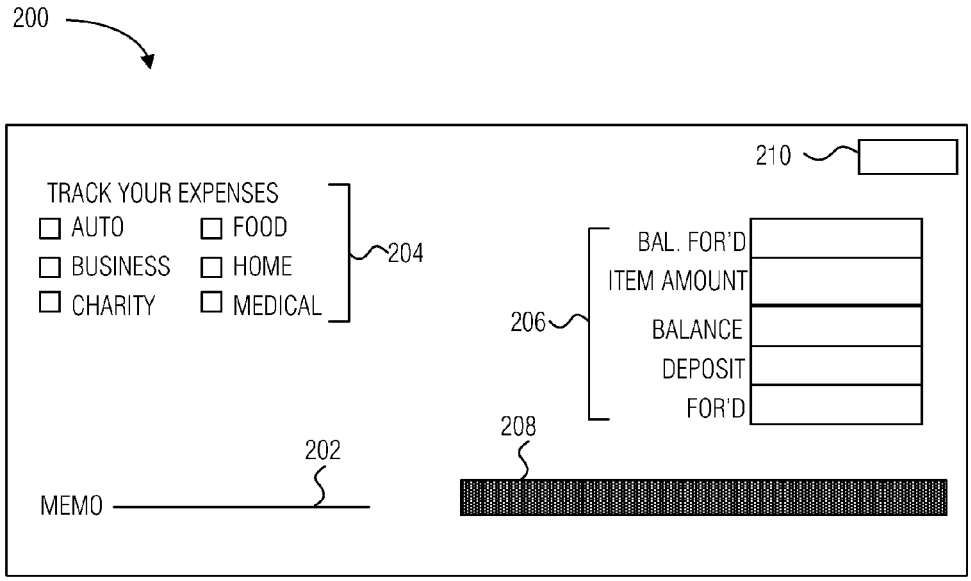
FIG. 2 is a simplified diagram of a check duplicate for the check in FIG. 1, according to one embodiment of the present subject matter.

FIG. 2 illustrates an example duplicate check 200. Duplicate check 200 does not include personalized information or bank specific contact information but does include a memo line 202, a tracking portion 204, a balancing portion 206, and a security box 208 (e.g., to obscure signature information). In an embodiment, check 200 includes portion 210 which has a photosensitive sensitive coating. Upon mating the original check and duplicate check and applying light, such as ultraviolet (UV) light, laser light or other visible light source, information from the original check will be transferred to the duplicate check in portion 210 through a photo chromic process or photo initiation process.

In other embodiments, varying arrangements and types of information are printed on the original and duplicate checks. For instance, a duplicate check may include the same bank information as the original check. In another embodiment, the original check does not include any personalized information. In yet another embodiment, additional portions of the duplicate check have the photosensitive coating applied. Other combinations of information and photosensitive portions may also be used.

In additional embodiments, there is more than one duplicate negotiable instrument for each original negotiable instrument. For example, a contract may have four copies that are mated to the original contract. Each of the duplicates can be a different color (e.g., the white, yellow, pink, and blue) and have different portions with the photosensitive coating applied.

Figure 3:
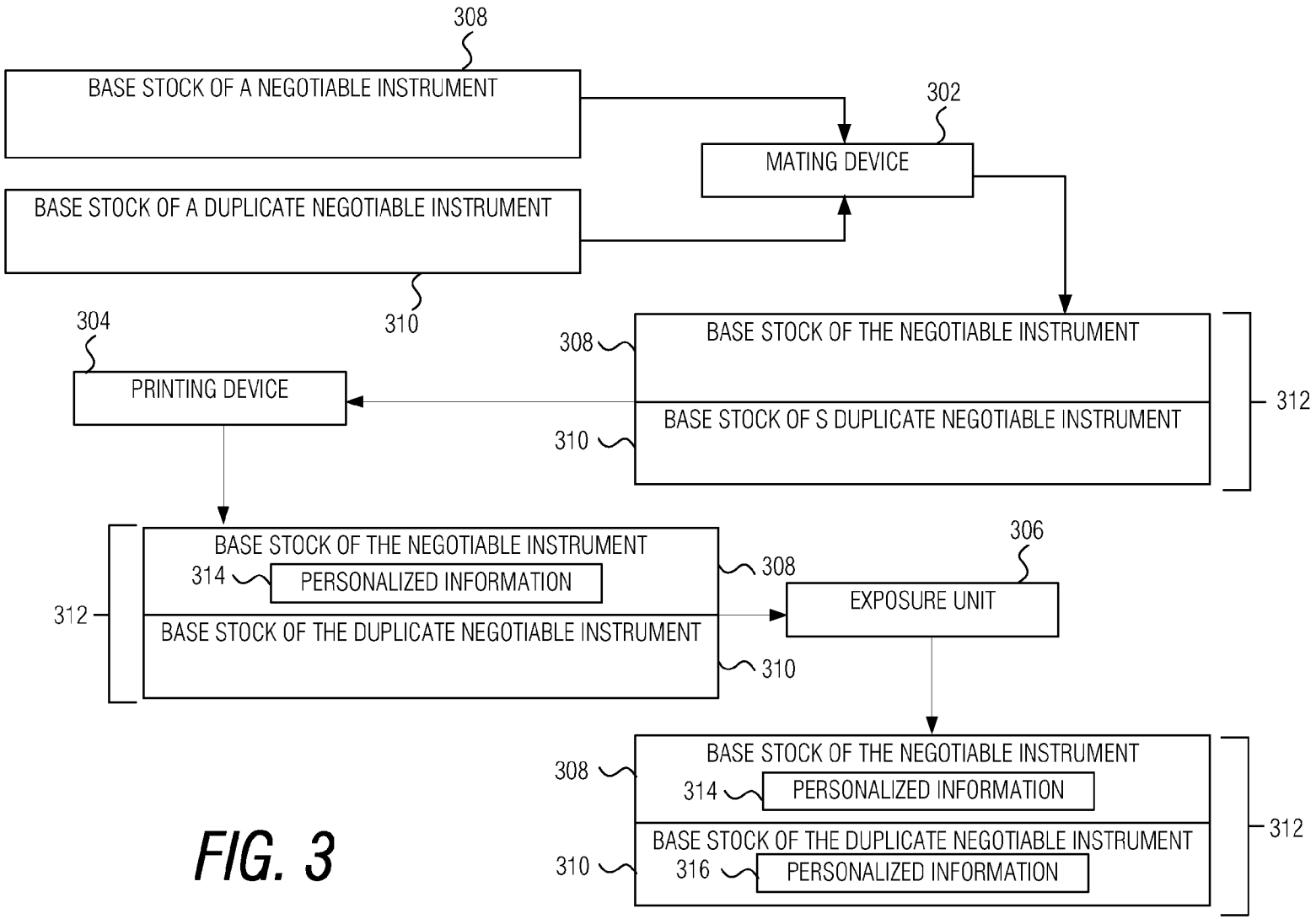
FIG. 3 is a block diagram of a printing system, according to one embodiment of the present subject matter.

FIG. 3 illustrates a block diagram of an example printing system 300. Printing system 300 includes a mating device 302, printing device 304, and an exposure unit 306. In an example embodiment, a mated check is created using a web press that converts white roll stock to individual sheets of negotiable instruments (e.g., checks). The web press accepts rolls of stock for original base stock and a roll of stock for the duplicate base stock. The original base stock is printed using color litho UV or cold set ink. The duplicate base stock is coated with a micro encapsulated dye. Additionally the duplicate base stock is printed with one color UV or cold set ink. In an embodiment, the light sensitive coating is applied to the duplicate base stock at the point of origin where the roll stock is produced. In further embodiments, the light sensitive coating is applied after the roll stock is produced. The original base stock and duplicate base stock are glued together in a web press and cut to sheets as a mated base stock.

In an embodiment, a base stock of a negotiable instrument (original base stock) 308 (e.g., a check) is mated with a base stock of a duplicate negotiable instrument (duplicate base stock) 310 using mating device 302. In an embodiment, original base stock 308 and duplicate base stock 310 are both a type of paper. In an embodiment the paper has a particular weight such as 141*b* to 171*b* for duplicate base stock and 201*b* to 241*b* for original base stock. In an embodiment, original base stock 308 and duplicate 310 have a top and bottom side in which the top side has information printed (e.g., bank information). In an embodiment, the top side of original base stock 308 and duplicate base stock 310 have information printed that is common to both base stock 308 and 310. For example, if the negotiable instrument is a check, a dollar box is printed on both base stocks. In other embodiments, the base stock of the negotiable instrument 308 is printed with information common to all checks and the base stock of the duplicate negotiable instrument is left blank. In various embodiments, no personalized information is printed on either base stock (e.g., no check numbers, account numbers, bank specific contact information, etc.)

In various embodiments, a photosensitive material is coated on portions of the top of the base stock of the duplicate negotiable instrument 310. The photosensitive material is coated on the regions of the duplicate negotiable instrument that correspond to the location of information printed on the original base stock 308 that is to be transferred to the duplicate base stock 310. For example, if the negotiable instrument is a check, there is a check number printed in the upper right corner. Thus, the photosensitive material is coated in the upper right corner of the duplicate base stock 310.

In one embodiment, mating device 302 mates base stock of a negotiable instrument 308 with base stock of a duplicate negotiable instrument 310 to form mated base stock 312. In an embodiment, the base stocks are printed separately and padded together at a later point in time. For example, loose sheets are printed with consecutive numbers and stacked post print. The stack is cut to size and then the ends are padded together with glue to create a sequence of original and duplicate alternating within the pad. In some embodiments, an adhesive is applied to the bottom of original base stock 308, the top side of duplicate base stock 310, or both. The adhesive is such that, upon mating, original base stock 308 and duplicate base stock 310 are separable without damaging the information, if any, printed on either base stock. In an embodiment, the adhesive is applied only to the edges of either base stock.

In an embodiment, printing device 304 prints personalized information 314 on the base stock of the negotiable instrument 308 portion of mated stock 312. Personalized information may include, but is not limited to, the information printed on check 100. In embodiments where the base stock of the negotiable instrument is blank before printing, additional information is printed. For example, when the negotiable instrument is a check, the signature, pay to, and memo lines are printed. In an embodiment, printing device 304 is a laser printer. In various embodiments the printer is an inkjet, thermographic, or other types of printer that has the capability to print at a density sufficient enough to block the exposure of light from exposure unit 306.

In an embodiment, mated base stock 312 passes under an exposure unit 306. Exposure unit 306 applies light to mated base stock 312. In an embodiment, the light is ultraviolet light. Upon exposure to the light, the printed personalized information 314 is transferred to the base stock of the duplicate negotiable instrument 310 as personalized information 316.

For example, the printed portion of base stock 308 creates a shadowing on the base stock of 310 which creates a difference in exposure between printed and non-printed areas of the duplicate negotiable instrument. The exposure creates a change in color on areas that have been coated with the photosensitive material. Through a photo chromic process, a shift occurs in the coated regions of the base stock of the negotiable instrument 312 which matches the shadowing (e.g., the printed information on base stock 310). For example, the photosensitive material may be blue when applied, but upon being exposed to the UV light, the exposed areas turn gray and the shaded image areas remain blue. Thus, if the base stock of the duplicate negotiable instrument 310 is completely coated in a photosensitive material, all the information printed on the base stock of the negotiable instrument 308 will be transferred to the base stock 310.

In some embodiment, the specifications of the exposure unit and base stock allow a legible transfer of information from the base stock of the negotiable instrument to the duplicate base stock. For example, the intensity, wavelength, distance, and time may have an effect on the transfer of information. In an embodiment, the thickness of the original base stock is 20-24 lb stock. The stocks are preprinted but have 30% or less coverage of the preprinted design in the exposed area that would need to transfer light. In an embodiment, the photosensitive material applied to the duplicate base stock will react within the UV light source's output range. In an embodiment, the light transferring through the original base stock provides a minimum of 30% light transfer to expose the treated areas of the duplicate base stock. The exposed area will fade and reveal the image shaded by the print on the top sheet. Also, in an embodiment, the photosensitive material is non-hazardous.

In an embodiment, the speed of the stock under the exposure source is 100-feet per minute (FPM). For example, the character field in an application where only the check number is printed can be 1.25" in length. In further applications, in digital production systems using standard 8.5"×11" paper, there may be a target range of achieving 200 FPM.

Figure 4:
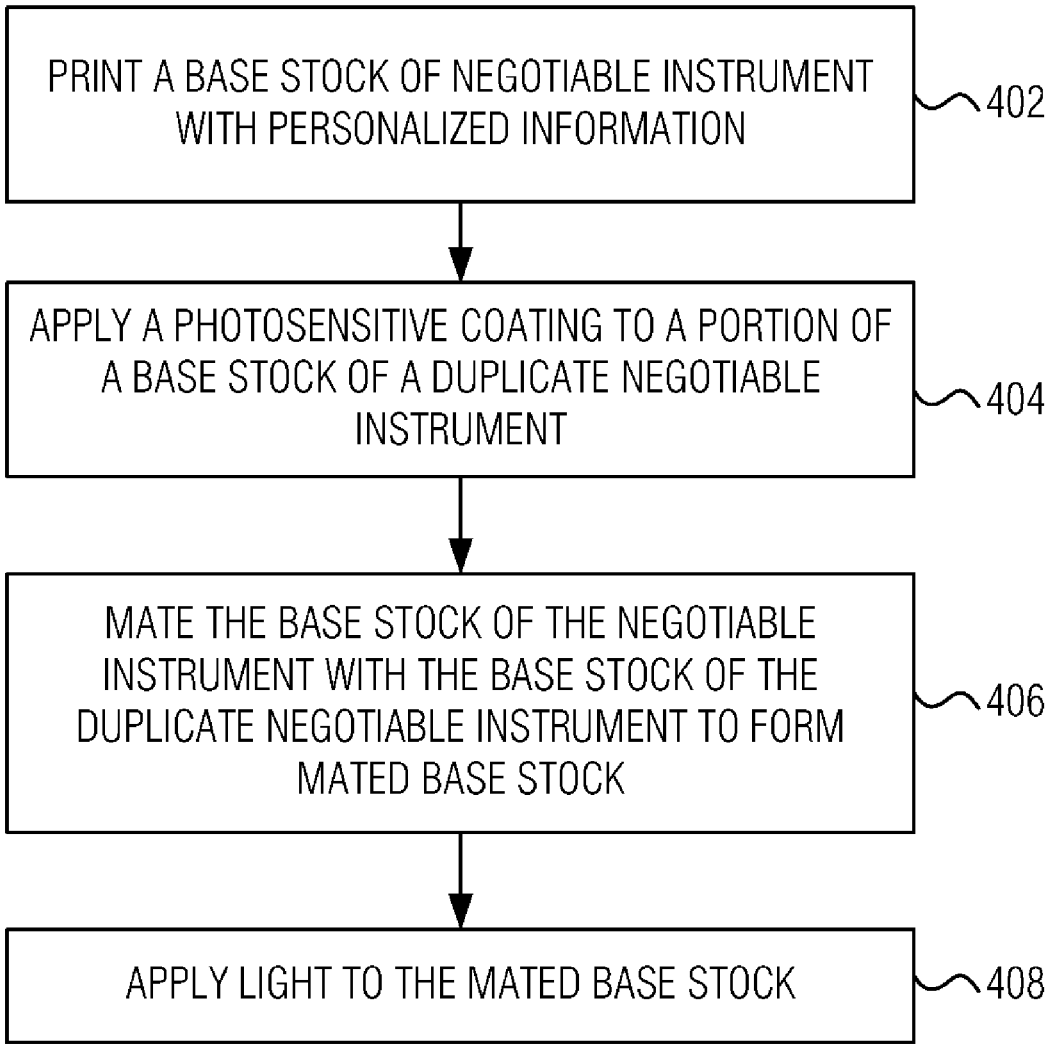
FIG. 4 is a flow diagram of a method for printing, according to one embodiment of the present subject matter.

FIG. 4 illustrates an example method for the production of printed negotiable instruments. At block 402, a base stock of negotiable instruments with personalized information is printed. In an embodiment, printing a base stock of a negotiable instrument includes printing a base stock of a check (e.g., check 1). In further embodiments, account information of a financial institution is printed on the base stock of the negotiable instrument. The account information may include the name, address, or both, of an account holder of the financial institution. In an embodiment, the personalized information includes a check number.

At block 404, a photosensitive coating is applied to a portion of a base stock of the a duplicate negotiable instrument. In an embodiment, the photosensitive coating is to provide transfer of selected personalized information from the negotiable instrument when light is applied to the mated base stock.

At block 406, the base stock of the negotiable instrument is mated with the base stock of the duplicate negotiable instrument to form mated base stock. At block 408, light is applied to the mated base stock. In an embodiment, the light is ultraviolet light.

Figure 5:
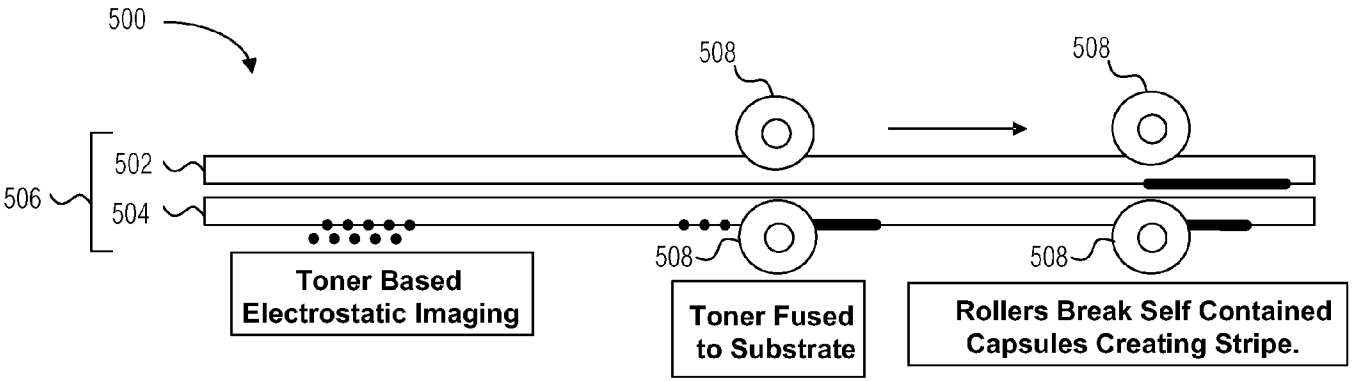
FIG. 5 is a diagram of a printing system, according to one embodiment of the present subject matter.
Figure 6:
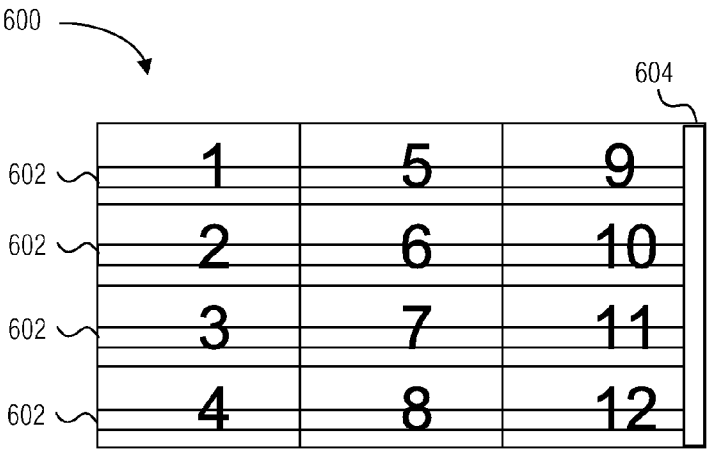
FIG. 6 is a diagram of a set of checks, according to one embodiment of the present subject matter.

FIG. 5 illustrates an example printing system 500. In an embodiment, a printing system includes a base stock of a negotiable instrument 502 (original base stock) and a base stock of a duplicate negotiable instrument 504 (duplicate based stock). The two base stocks are mated together to form a mated base stock 506. The mated base stock is fed through a set of rollers 508 to break dye capsules on the back of the original base stock. The broken dye capsules mix with a coating on the front of the duplicate base stock. In an embodiment, the coating and dye capsules are both clear when separated. The mixing creates a blue or black carbonless stripe. This is similar to when a person writes a check and the pressure of a pen breaks the dye capsules such that any information written with the pen is transferred to the duplicate check. FIG. 6 illustrates an example set of checks 600 which have been pressed by rollers to create a strip 602 of burst capsules that covers the entire surface area contacted by the rollers. Also illustrated is glue 604 which holds the check and duplicate checks together.

Figure 7:
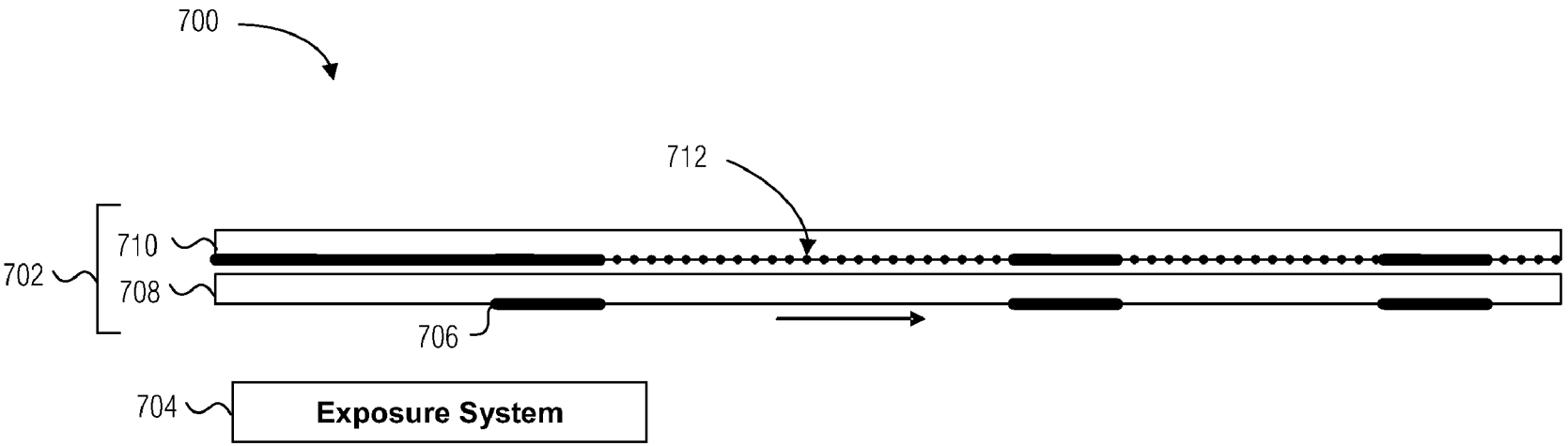
FIG. 7. is a diagram of an exposure system, according to one embodiment of the present subject matter.

FIG. 7 illustrates an example exposure system 700. In an embodiment, the mated base stock 702 passes under an exposure unit 704 which exposes mated base stock 702 to a light (e.g., laser light, UV light, or a visible light source) to activate the exposed area of the previously burst capsules which turns the exposed areas back to a neutral state 712. Printed material 706 on the original base stock 708 shields the light from exposing portions of the duplicate base stock 710 thereby creating a legible transfer of information from the printed material from the original base stock to the duplicate base stock.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A method for the production of printed negotiable instruments, comprising printing a base stock of a negotiable instrument with personalized information;

applying a photosensitive coating to at least one portion of a base stock of a duplicate negotiable instrument;

mating the base stock of the negotiable instrument with the base stock of the duplicate negotiable instrument to form a mated base stock;

applying light to the mated base stock; and transferring the personalized information to the base stock of the duplicate negotiable instrument in the at least one portion of the base stock of the duplicate negotiable instrument coated with the photosensitive coating using the application of the light.

2. The method of claim 1, wherein printing a base stock of a negotiable instrument with personalized information includes printing a check number.

3. The method of claim 1, wherein applying the photosensitive coating to the at least one portion of the base stock of the duplicate negotiable instrument includes:

applying the photosensitive coating to areas corresponding to areas where personalized information is printed on the base stock of the negotiable instrument.

4. The method of claim 1, wherein applying light to the mated base stock includes:

applying ultraviolet light.

5. The method of claim 1, further comprising:

printing a second base stock of the duplicate negotiable instrument.

6. A system comprising:

a base stock of a duplicate negotiable instrument coated with a photosensitive material on at least one portion of the base stock;

a mating device to mate a base stock of the negotiable instrument with the base stock of the duplicate negotiable instrument to form mated base stock;

a printing device to print personalized information on the base stock of the negotiable instrument; and an exposure unit to apply light to the mated base stock and to transfer the personalized information to the base stock of the duplicate negotiable instrument in the at least one portion of the base stock of the duplicate negotiable instrument.

7. The system of claim 6, wherein the base stock of the negotiable instrument and base stock of the duplicate negotiable instrument are both a type of paper.

8. The system of claim 7, wherein the weight of the base stock of the duplicate negotiable instrument is of less weight than the weight of the base stock of the negotiable instrument.

9. The system of claim 6, wherein the base stock of the negotiable instrument provides a minimum of 30% light transfer.

10. The system of claim 6, wherein the light is ultraviolet light.

11. The system of claim 6, wherein the printing device is a laser printer.

12. A method comprising:

printing a base stock of a negotiable instrument with information, the base stock of the negotiable instrument having dye capsules disposed on at least a portion of the negotiable instrument;

coating a base stock of a duplicate negotiable instrument with a coating;

mating the base stock of the negotiable instrument with the base stock of the duplicate negotiable instrument to form a mated base stock;

passing the mated base stock through a set of rollers;

breaking the dye capsules where the rollers contact the base stock of the negotiable instrument;

mixing the broken dye capsules with the coating;

exposing the mated base stock to light; and transferring the information onto the base stock of the duplicate negotiable instrument where the broken dye capsules are mixed with the coating and have been exposed to the light.

13. The method of claim 12, wherein printing a base stock of a negotiable instrument with printed matter includes printing a check number.

14. The method of claim 12, wherein passing the mated base stock through a set of rollers includes creating a carbonless stripe where the rollers contact the mated base stock.

15. The method of claim 12, further includes gluing the base stock of the negotiable instrument to the base stock of the duplicate negotiable instrument.

16. The method of claim 12, wherein exposing the mated base stock to light includes exposing the mated base stock to ultraviolet light.

17. A system comprising:

a base stock of a negotiable instrument with printed information and with dye capsules disposed on the base stock of the negotiable instrument;

a coated base stock of a duplicate negotiable instrument;

a set of rollers to press the mated base stock together, break the dye capsules and to mix the broken dye capsules with the coating on the base stock of the duplicate negotiable instrument; and a light exposure unit to expose light to the mated base stock and to transfer the printed information to the base stock of the duplicate negotiable instrument where the broken dye capsules are mixed with the coating.

18. The system of claim 17, wherein the dye capsules are clear when separate from the coating on the base stock of the duplicate negotiable instrument.

19. The system of claim 17, wherein the coating is clear when separate from the dye capsules.

20. The system of claim 17, wherein the light is ultraviolet light.

* * * * *